US007313350B2

(12) United States Patent
Yamamura

(10) Patent No.: US 7,313,350 B2
(45) Date of Patent: Dec. 25, 2007

(54) DEVELOPING APPARATUS AND IMAGE FORMING APPARATUS

(75) Inventor: Akihiro Yamamura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 50 days.

(21) Appl. No.: 11/042,583

(22) Filed: Jan. 25, 2005

(65) Prior Publication Data

US 2005/0163538 A1 Jul. 28, 2005

(30) Foreign Application Priority Data

Jan. 27, 2004 (JP) ..... 2004-018599

(51) Int. Cl.
*G03G 15/08* (2006.01)

(52) U.S. Cl. ..... 399/279

(58) Field of Classification Search ..... 399/279
See application file for complete search history.

(56) References Cited

U.S. PATENT DOCUMENTS

2002/0086781 A1* 7/2002 Okuda et al. ..... 492/56
2002/0127033 A1* 9/2002 Inoue et al. ..... 399/279
2003/0013032 A1* 1/2003 Fields et al. ..... 430/122
2003/0054269 A1* 3/2003 Yamazaki et al. ..... 430/45
2003/0091923 A1* 5/2003 Kobayashi et al. ..... 430/111.33
2003/0232185 A1* 12/2003 Shimamura et al. ..... 428/323
2004/0191662 A1* 9/2004 Matsumura et al. ..... 430/109.3

FOREIGN PATENT DOCUMENTS

JP 11-072960 A 3/1999
JP 2005215501 * 8/2005

* cited by examiner

*Primary Examiner*—Anjan Deb
*Assistant Examiner*—Jeff Natalini
(74) *Attorney, Agent, or Firm*—Akin Gump Strauss Hauer & Feld LLP

(57) ABSTRACT

A developing apparatus develops an electrostatic latent image formed on a photoconductive drum with toner into a toner image. A developing roller has a surface on which a thin layer of toner is formed. The developing roller has a ten-point height of irregularities Rz such that 1 μm<Rz<DV and in pressure contact with the photoconductive drum to supply the toner to the electrostatic latent image. DV is a volume mean particle diameter. A developing blade is pressed against the surface of the developing roller to form a thin toner layer on the developing roller. The toner has parameters (1) 1 μm<DV<7 μm, (2) 0.9<roundness<0.97, (3) small-diameter particles (not larger than DV×0.5 μm) of not more than 20% by number percentage, (4) large-diameter particles (not smaller than DV×2.0 μm) of not more than 1% by volume percentage.

7 Claims, 5 Drawing Sheets

DEVELOPING APPARATUS AND IMAGE FORMING APPARATUS

FIELD OF THE INVENTION

The present invention relates to a developer and an image-forming apparatus.

DESCRIPTION OF THE RELATED ART

Among conventional electrophotographic image-forming apparatus are an electrophotographic printer, a copying machine, and a facsimile machine. Such apparatus use an electrophotographic image-forming process including exposing, developing, transferring, and fixing. That is, a charging roller charges the surface of a photoconductive drum to a predetermined potential. Then, an exposing unit irradiates the charged surface of the photoconductive drum with light in accordance with print data to form an electrostatic latent image. A developing roller applies developer to the electrostatic latent image to develop the electrostatic latent image in to a visible image. A transfer roller transfers the visible image onto a recording medium. The visible image on the recording medium is then fixed in a fixing unit.

Image-forming apparatus that use an electrophotographic process usually employ small pixels in order to meet the requirement of high quality image. For this reason, conventional image-forming apparatus use small-diameter toner.

For meeting the aforementioned requirements, Japanese Patent Laid-Open No. 11-72960 discloses a toner that meets the requirements for volume mean particle diameter, amounts of large toner particles and small toner particles, the roundness (i.e., shape) of toner particles, and the size and amount of inorganic particles added to the toner.

One of the problems with conventional image-forming apparatus is that when a thin layer of toner is formed on a developing roller, the Coulomb force causes small-diameter toner to become packed or tacked to surrounding structural members. Thus, such behavior of the toner particles is difficult to control, causing difficulties in ensuring that a thin layer of toner is formed with a uniform thickness.

With developing units for electrophotography, a toner layer of non-uniform thickness does not allow the toner particles on the developing roller to be charged uniformly, causing poor printing results such as soiling, degradation of graininess, and non-uniform density of image. Degradation of graininess is a phenomenon where toner fails to develop small dots so that toner particles are absent from or come off a printed image, thereby causing white areas in printed images.

As described above, controlling the shape of toner particles is not enough to ensure uniform thickness of toner layer formed on the developing roller because the friction between the developing roller and developing blade causes the toner particles to deform, or dimensional errors of these structural members causes non-uniform thickness of the toner layer on the developing roller.

SUMMARY OF THE INVENTION

An object of the invention is to provide a developing apparatus and an image-forming apparatus in which a uniform toner layer can be formed even if respective structural members are subjected to dimensional variations and wear-out over time, or the characteristics of the respective structural members deteriorate due to varying environmental conditions.

Another object of the invention is to provide an image-forming apparatus in which a cleaning blade formed of a resilient material such as rubber is used to promptly remove residual toner on a photoconductive drum that failed to be transferred onto a recording medium.

A developing apparatus develops an electrostatic latent image formed on an image-bearing body with a developer into a visible image. A developer-bearing body has a surface on which a thin layer of the developer material is formed, the developer-bearing body being disposed such that the surface is brought into pressure contact with the image-bearing body. A developer-supplying body supplies the developer to the surface of the developer-bearing body. A toner layer-forming member is in pressure contact with the surface of the developer-bearing body to form a thin layer of the developer on the developer-bearing body. The developer has parameters:

(1) 1 μm<DV<7 μm, (2) 0.9<roundness<0.97, (3) small-diameter particles (not larger than DV×0.5 μm) of not more than 20% by number percentage, (4) large-diameter particles (not smaller than DV×2.0 μm) of not more than 1% by volume percentage, where DV is volume mean particle diameter of toner particles;

wherein the surface has an average surface roughness Rz such that 1 μm<Rz<DV where Rz is ten-point height of irregularities.

The toner-layer forming member has a plate-like shape and a bent portion at which the toner layer-forming member is in pressure contact with the developer-bearing body under a line pressure in the range of 20 to 60 g/cm$^2$. The bent portion has a radius of curvature in the range of 0.15 to 0.50 mm.

The surface of the developer bearing body is a cylindrical surface and the toner layer-forming member has a flat surface in pressure contact with the surface of the developer-bearing body under a line pressure in the range of 30 to 120 g/cm$^2$. The toner layer-forming member extends over a distance in the range of 0.5 to 2.2 mm ahead of a contact point at which the toner-layer forming member is in contact with the developer-bearing body.

The toner layer-forming member is made of stainless steel.

The developer is manufactured by emulsion polymerization.

An image forming apparatus incorporates the aforementioned developing apparatus. A cylindrical image-bearing body rotates about a longitudinal axis. A transfer member transfers the visible image from the image-bearing body onto a recording medium. A resilient cleaning blade is in contact with a cylindrical surface of the cylindrical image-bearing body, the resilient cleaning blade scrapes off residual developer from a surface of the cylindrical image-bearing body.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

{Construction}

Figure 1:
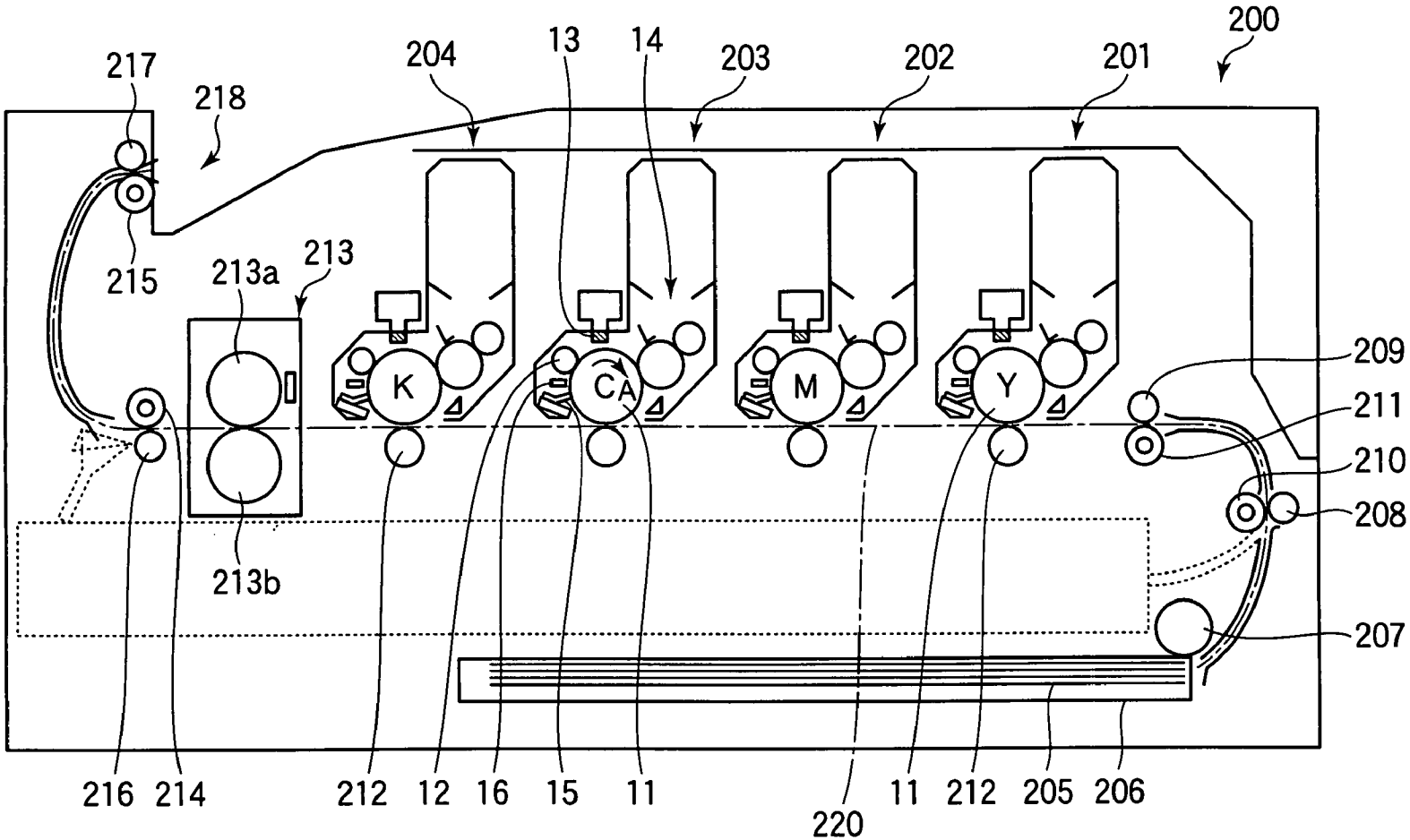
FIG. 1 is a schematic view of an image-forming apparatus having a developing unit according to the present invention.

FIG. 1 is a schematic view of an image-forming apparatus having a developing unit according to the present invention.

Referring to FIG. 1, an image-forming apparatus 200 includes four process units 201-204 for forming yellow, magenta, cyan, and black images, respectively. The process units 201-204 are aligned from upstream to downstream with respect to a direction in which a recording medium 205 advances in a transport path 220. Each of the process units 201-204 is substantially identical; for simplicity only the configuration of the process unit 203 for cyan image will be described, it being understood that the other cartridges 20 may work in a similar fashion.

The process unit 203 is disposed so that a photoconductive drum 11 rotates in a direction shown by arrow A. Disposed around the photoconductive drum 11 are a charging roller 12, an exposing unit 13, a developing unit 14, a cleaning blade 15, and a neutralizing unit 16. The charging roller 12 charges the surface of the photoconductive drum 11. The exposing unit 13 selectively irradiates the charged surface of the photoconductive drum 11 with light in accordance with print data to form an electrostatic latent image. The developing unit 14 applies toner to the electrostatic latent image to develop the electrostatic latent image into a toner image. The cleaning blade 15 removes residual toner remaining on the photoconductive drum 11 after the toner image is transferred onto a recording medium 205. The neutralizing unit 13 neutralizes the residual charges on the photoconductive drum 11. The photoconductive drum 11 and rollers disposed around the photoconductive drum 11 are driven in rotation by a drive source, not shown, through, for example, gears.

A paper cassette 206 is disposed at a lower end portion of the image-forming apparatus 200 and holds a stack of recording medium 205 such as paper. A hopping roller 207 is disposed above the paper cassette 206 and feeds the recording medium 205 on a page-by-page basis into the transport path 220. Provided downstream of the hopping roller 207 with respect to the transport path 220 are a transport roller 210 and a pinch rollers 208 that hold the recording medium 205 in sandwiched relation and transport the recording medium 205 through the transport path 220. Provided further downstream of the transport roller 210 area registry roller 211 and a pinch roller 209 that remove skew of the recording medium 205 and transport the recording medium 205 to the process unit 201. A drive source, not shown, drives the hopping roller 207, transport roller 210, and registry roller 211 in rotation through, for example, gears.

Transfer rollers 212 are disposed to oppose corresponding photoconductive drums 11 of the respective process units 201-204. When the transfer rollers 212 transfer the toner image onto the recording medium 205, the transfer rollers 212 receive a high voltage such that a potential difference is created between the surfaces of the photoconductive drums 11 and the surfaces of the corresponding transfer rollers 212.

The fixing unit 213 includes a heat roller 213*a* and a backup roller 213*b* that apply heat and pressure, respectively, onto the recording medium 205 passing between the heat roller 213*a* and backup roller 213*b*. A discharge roller 214 cooperates with a pinch roller 216 to hold the recording medium 205 in sandwiched relation and transports the recording medium 205 to a discharge roller 218, which in turn cooperates with a pinch roller 217 to discharge the recording medium 205 onto a stacker 218. The heat roller 213*a*, backup roller 213*b*, discharge rollers 214 and 215, and pinch rollers 216 and 217 are rotated through gears by a drive source, not shown.

{Operation of Image Forming Apparatus}

The operation of the image-forming apparatus 200 of the aforementioned configuration will be described. The hopping roller 207 feeds the recording medium 205 on a page-by-page basis from the paper cassette 206 into the transport path 220. Subsequently, the recording medium 205 is sandwiched between the transport roller 210 and the pinch roller 208 and then transported to the registry roller 211 and the pinch roller 209, which in turn feed the recording medium 205 between the photoconductive drum 11 of the process unit 201 and the transfer roller 212. When the recording medium 205 is sandwiched and advanced between the photoconductive drum 11 and the transfer roller 212, the toner image is transferred onto the recording medium 205.

Thereafter, the recording medium 205 passes through the process units 202-204 in sequence so that the toner images of corresponding colors are transferred onto the recording medium 205 one over the other in registration.

Then, the recording medium 205 advances into the fixing unit 213 where the toner images of the respective colors are fixed into a permanent color image. Then, the recording medium is discharged by the discharge rollers 214 and 215 and pinch rollers 216 and 217 onto the stacker 218.

Figure 2:
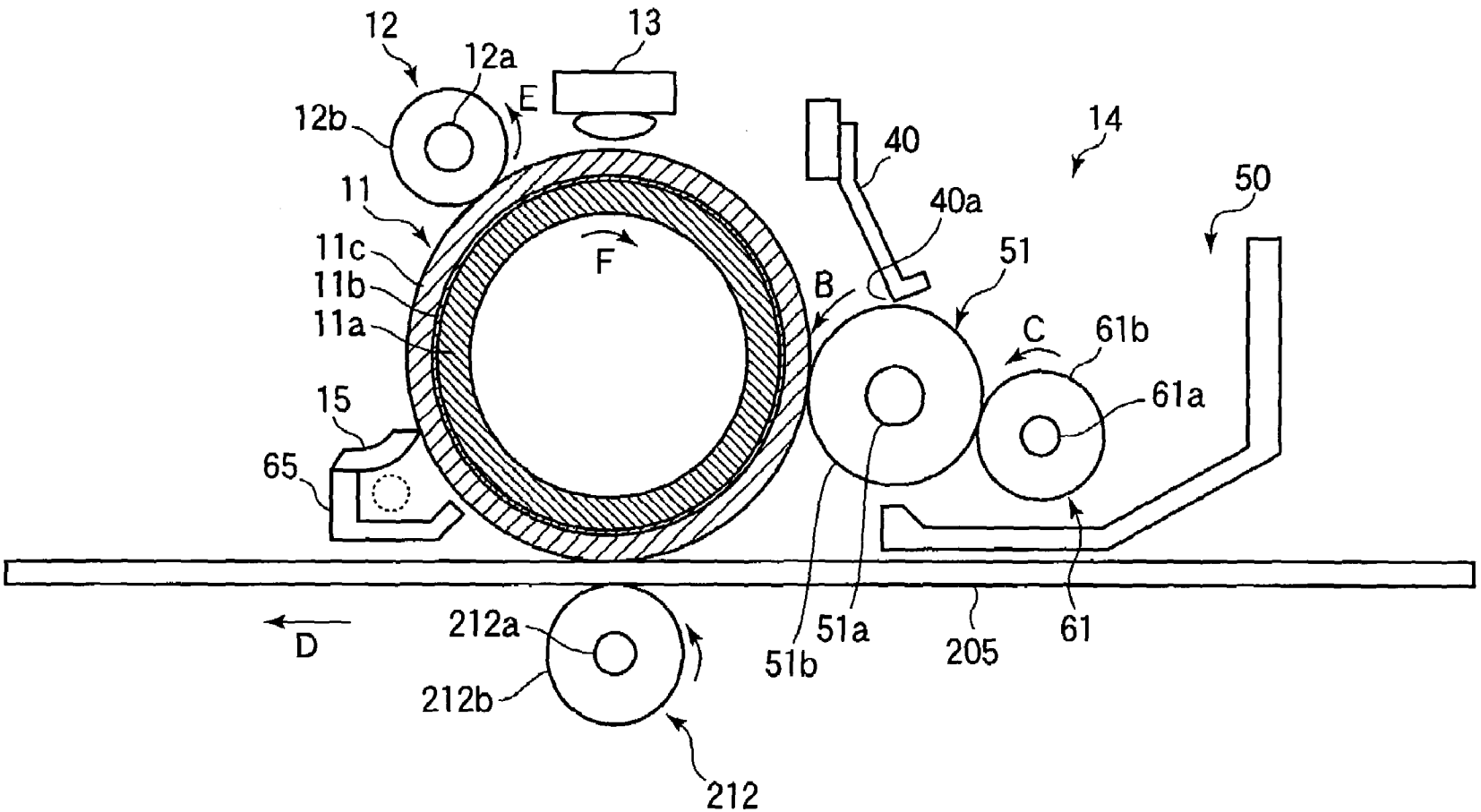
FIG. 2 is an expanded view of a process unit for cyan image illustrating a photoconductive drum and surrounding structural elements.

FIG. 2 is an expanded view of the process unit 203 for cyan image illustrating the photoconductive drum 11 and surrounding structural elements.

Referring to FIG. 2, the developing unit 14 includes a toner reservoir 50 that holds toner therein. A toner cartridge, not shown, supplies toner to the reservoir 50 whenever necessary. The toner is a non-magnetic one-component type in which a coloring material is dispersed in a thermoplastic resin and the thermoplastic resin is processed into small-diameter particles.

The toner-layer forming member has a plate-like shape and a bent portion at which the toner layer-forming member is in pressure contact with the developer-bearing body under a line pressure in the range of 20 to 60 g/cm$^2$. The bent portion has a radius of curvature in the range of 0.15 to 0.50 mm.

The surface of the developer bearing body is a cylindrical surface and the toner layer-forming member has a flat surface in pressure contact with the surface of the developer-bearing body under a line pressure in the range of 30 to 120 g/cm$^2$. The toner layer-forming member extends over a distance in the range of 0.5 to 2.2 mm ahead of a contact point at which the toner-layer forming member is in contact with the developer-bearing body.

The developing unit 14 includes a developing roller 51, a toner-supplying roller 61, and a developing blade 40. The developing unit 14 develops the electrostatic latent with toner into a toner image. The developing roller 51 and toner-supplying roller 61 extend in their longitudinal directions that are parallel to each other. The developing roller 51 and toner-supplying roller 61 are in pressure contact with each other and rotate in directions shown by arrows B and C, respectively.

As shown, the developing blade 40 and developing roller 51 extend in parallel to each other, so that a bent portion 40*a* of the developing blade 40 applies a predetermined pressure on the circumferential surface of the developing roller 51. The predetermined pressure is uniformly distributed across the length of the developing roller 51.

The developing roller 51 has a core metal 51*a* on which a conductive resilient layer 51*b* is formed. The conductive resilient layer is, for example, a resilient rubber having an electrical resistance adjusted by dispersing a predetermined amount of an electrically conductive material. The outer surface of the developing roller 51 is covered with urethane rubber, not shown. The toner-supplying roller 61 has a metal core 61*a* on which a conductive resilient layer 61*b* is formed. The conductive resilient layer 61*b* is, for example, a resilient rubber having an electrical resistance adjusted by dispersing a predetermined amount of an electrically conductive material. The developing roller 51 and toner-supplying roller 61 receive high voltages from a high voltage power supply under control of a controller, not shown.

The charging roller 12 rotates in contact with the photoconductive drum 11. The charging roller 12 has a metal core 12*a* on which a conductive resilient layer 12*b* is formed. The conductive resilient layer 12*b* is, for example, a rubber having an electrical resistance adjusted by dispersing an appropriate amount of an electrically conductive material. The charging roller 12 receives a high voltage from a high voltage power supply under control of a controller, not shown. The photoconductive drum 11 has a base body 11*a* in the form of a metal hollow cylinder on which a charge-generating layer 11*b* is formed. The charge-generating layer 11*b* is covered with a charge-transferring layer 11*c*. The charge-transferring layer 11*c* transfers the charge carriers injected from the charge generating layer 11*b*. Thus, the photoconductive drum 11 has a laminated structure.

The exposing unit 13 has an light emitting diode (LED) head that selectively illuminates areas on the charged surface of the photoconductive drum 11 in accordance with print data to form an electrostatic latent image. The recording medium 205 such as paper is transported through the transport path 220 (FIG. 1) in the direction shown by arrow D. The transfer roller 212 has a metal core 212*a* on which a conductive resilient layer 212*b* is formed. The conductive resilient layer 212*b* is, for example, a rubber having an electrical resistance adjusted by dispersing a predetermined amount of carbon or the like. The transfer roller 212 rotates in contact with the photoconductive drum 11 so that the recording medium 205 is pulled in between the transfer roller 212 and the photoconductive drum 11 and is then further advanced. The transfer roller 212 receives a high voltage from a high voltage power supply under the control of a controller, not shown.

The cleaning blade 15 is a resilient blade formed of a resilient material such as urethane. The cleaning blade 15 extends in parallel to the photoconductive drum 11 and is pressed against the photoconductive drum 11 under a predetermined pressure. The cleaning blade 15 scrapes the residual toner off the photoconductive drum 11. The residual toner scraped off the photoconductive drum 11 is transported by a toner-transporting means, not shown, to a toner reservoir, and finally collected by a toner-collecting mechanism 65.

The image-forming apparatus 200 (FIG. 1) according to the present invention has a controller and a temperature-and-humidity detector, not shown. The controller performs overall control of the image-forming apparatus and includes primarily an arithmetic operation means such as CPU and MPU, a memory means such as a semiconductor memory and a magnetic disk, and a communication interface. The temperature-and-humidity detector detects the temperature and humidity of the environment in which the image-forming apparatus 200 operates, and sends the measured values of temperature and humidity to the controller. In accordance with the number of printed pages stored in the memory and the values of temperature and humidity of the environment, the controller controls the voltages supplied to developing roller 51 and toner-supplying roller 61 in such a way that a constant print density is obtained.

{Toner}

The toner according to the present invention will now be described. The toner according to the invention has (1) a volume mean particle diameter DV such that 1 μm<DV<7 μm; (2) a particle size distribution such that the number of small particles of not larger than DV×0.5 μm represents not larger than 20% of the total number of toner particles and the volume of large particles of not smaller than DV×2.0 μm represents not more than 1% of the total volume of toner. It is desirable that volume mean particle diameter DV in μm and population mean particle diameter DN in μm are related such that $1.0 \leqq DV/DN \leqq 1.2$. The particle diameter of toner was measured with Model II COULTER MULTISIZER available from COULTER.

Too large a value of volume mean particle diameter DV fails to print minute dots and is therefore not suitable for printing high-resolution images. Too small a value of volume mean particle diameter DV results in an increase in surface area per unit of weight of toner, so that toner particles contact their adjacent toner particles and surrounding structural members more often. This increases chances of the toner particles of acquiring charges, so that an amount of charge per unit of weight of toner increases. For this reason, the toner particles adhere to the surrounding structural members and become packed to reduce their fluidity, making it difficult for the toner-supplying roller 61 to supply toner to the developing roller 51 as well as making it difficult for the developing blade 40 to form a thin layer of toner on the developing roller 51.

In order for the toner particles to be uniformly distributed on the developing roller 51, it is important that the toner particles are uniform in size. In other words, the diameter of toner particles should not be extremely large or small compared with the volume mean particle diameter DV, i.e., the particle size should be distributed in a narrow range. Because toner acquires charges through friction engagement with the developing roller 51 and developing blade 40, the distribution of particle size in a narrow range allows the toner particles to be charged uniformly.

The value of DV/DN represents the degree of the distribution of particle size and is 1 or larger. When the value of DV/DN is equal to 1, all the particles have the same diameter. It is desirable that the value of DV/DN is small. However, to implement a small value of DV/DN, it is necessary to remove large-diameter particles and small-diameter particles from the toner by classifying. This is difficult.

The toner according to the invention is preferably highly spherical, i.e., the roundness of the toner particles should be in the range of 0.90 to 0.97. Roundness is given by the following equation.

Roundness=(peripheral length of a circle having an area equal to a projected area of a particle)/(peripheral length of the projected area of the particle)

A roundness of 1 represents that the projected area is a true circle. Roundness becomes smaller as the shape of toner becomes less circular. When the roundness of toner is smaller than 0.90, i.e., the toner particles have surface roughness more than necessary, the friction between the developing roller 51 and the toner particles increases so that a larger amount of toner on the developing roller 51 moves to the developing blade 40 to form a thicker toner layer on the developing roller 51. If the toner has a roundness larger than 0.97, the toner is difficult to be transferred onto the recording medium 205 and it is difficult for the cleaning blade 40 to scrape the residual toner off the photoconductive drum 11. Thus, the toner which failed to be transferred onto the recording medium 205 remains on the photoconductive drum 11 and adheres to the charging roller 12 causing a problem.

In the present embodiment, a scanning electron microscope Model S-2380 (from HITACHI) was used to sample an magnified image equivalent to 100 particles of toner. Then, the image was analyzed with an image analyzing software, SALT (from MITANI SHOHJI), thereby calculating the roundness of the toner particles according to the above-mentioned equation.

The toner according to the present embodiment has preferably a fluidity of not less than 70%. The toner should have high fluidity. However, if an additive is added to the toner to increase fluidity, the charging characteristic and the hot-melt characteristic of the toner vary depending on the amount of additive, thereby resulting in poor fixing performance.

Fluidity of toner was measured with a powder tester (available from HOSOKAWA MICRON) by the condensation method. Three types of meshes having meshes of 150 μm, 75 μm, and 45 μm, respectively, were stacked in this order from top. Then, 4 grams toner was placed on the upper mesh and the three meshes were subjected to a vibration having an amplitude of 0.2 mm and a duration of 15 seconds. The amounts of toner left on the respective meshes were measured and agglomeration was calculated as a sum of the following equation (1), (2), and (3).

$$A=(\text{amount of toner left on upper mesh}/4\text{ g})\times 100 \quad (1)$$

$$A=(\text{amount of toner left on middle mesh}/4\text{ g})\times 100\times(3/5) \quad (2)$$

$$A=(\text{amount of toner left on lower mesh}/4\text{ g})\times 100\times(1/5) \quad (3)$$

$$\text{Agglomeration }(\%)=A+B+C \quad (4)$$

$$\text{Fluidity }(\%)=100-\text{agglomeration }(\%) \quad (5)$$

{Method of Manufacturing Toner}

Toner can be manufactured by a variety of methods such as pulverization, suspension polymerization, and emulsion polymerization. While the toner according to the invention may be manufactured by any method provided that a toner having the aforementioned shape can be manufactured, the emulsion method is recommended for the following reasons. The roundness of toner particles can be controlled at will by setting proper conditions in the agglomeration process. Controlling the diameter of primary particles within several tens of nanometers allows manufacturing of toner having a small particle size. Additives such as pigment and wax can be encapsulated that would otherwise adversely affect the charging characteristic and fluidity of the toner if the additives are present on the surface of the toner particles.

{Emulsion Polymerization}

The manufacture of toner by emulsion polymerization will be described. Amounts of external additives in weight parts represent a proportion to 100 parts toner particles throughout the specification. In emulsion polymerization, primary particles of a polymer that is a binding resin for toner are manufactured in a water medium. Then, this water medium is mixed with a coloring agent that has been emulsified using an emulsifying agent (surface active agent), with additional materials such as a wax and a charge control agent as required. Then, the material in the water medium is allowed to agglomerate, thereby manufacturing toner particles in the water medium. Then, the toner particles are taken out of the water medium, cleaned, and finally dried, thereby removing unwanted components of solvent and byproducts. This completes the manufacture of toner.

More specifically, the styrene acrylic copolymer resin as a primary particle is obtained from styrene, acrylic acid, and methyl methacrylate in the water medium. The coloring agents are carbon black for black, PIGMENT YELLOW 74 for yellow, PIGMENT RED 238 for magenta, and PIGMENT BLUE 15:3 for cyan. The wax was stearyl stearate as a higher fatty acids ester wax. The primary particles, coloring agent, and wax are mixed and agglomerated into toner particles.

In order to ensure the fluidity of toner, 1 to 3 weight parts silica having a particle diameter in the range of 8 to 20 nm is added to the toner. Adding silica particles to the toner will prevent agglomeration of the toner particles that would otherwise result from contact of particles one another due to Vander Waals forces. This improves the fluidity of toner. If the silica particles added have diameters smaller than 8 nm or an amount less than 1 weight parts, the silica particles are not effective enough in preventing the toner particles from being attracted to one another due to Vander Waals forces. Thus, the layer of toner formed on the developing roller 51 has not a uniform thickness.

On the other hand, if the silica particles added have diameters larger than 8 nm, silica particles that have once adhered to the surfaces of toner particles tend to come off. Further, if the silica particles added has an amount larger than 3 weight parts, a large amount of silica come off the surfaces of toner particles. As a result, when the apparatus is being operated, the silica that have come off the surface of toner particles will adhere to the developing roller 51, developing blade 40, and photoconductive drum 11. Thus, streaks and variation of density will appear in the resulting images.

{Developing Roller}

The developing roller 51 according to the present embodiment will be further described.

The developing roller 51 has an electrically conductive resilient layer 51*b* in which an electrically conductive material is dispersed as previously described. The surface of the developing roller 51 has a ten-point height of irregularities Rz that is not less than 1 μm and less than a volume mean particle diameter DV. A surface roughness Rz of the developing roller 51 smaller than 1 μm reduces the ability of the developing roller 51 to transport the toner, making it difficult to form a toner layer of a uniform thickness. A surface roughness Rz of the developing roller 51 larger than its volume mean particle diameter DV allows the toner layer to have a smooth surface but not a uniform thickness. The charging of toner is accomplished by the contact between the toner and the developing roller 51 and the friction between the toner and the developing blade 40. A non-uniform thickness causes non-uniform charging of the toner. Such non-uniform charging of toner causes poor quality of printed images such as soiling of printed images and deterioration of graininess.

The developing roller 51 is covered with a resin that prevents deposition of melted toner. Such a resin is combined with a silicone group or a fluorine group to have good slip. Alternatively, in order to control the charging of toner, additives are added to the developing roller 51 depending on the material and configuration of toner.

Thus, the actual developing roller 51 has a stainless core metal 51*a* covered with an electrically conductive resilient layer 51*b* of silicone rubber in which a predetermined amount of carbon is dispersed. The developing roller 51 is manufactured with an extrusion molding machine. Because the electrically conductive resilient layer 51*b* rotates in contact with the photoconductive drum 11, silicone rubber may be deposited on the surface of the photoconductive drum 11 during storage. Further, silicone oligomer will separate out from the electrically conductive resilient layer 51*b* to contaminate the surface of the photoconductive drum 11. Thus, the deposition of silicone rubber and oligomer on the photoconductive drum 11 will cause periodical lateral streaks to appear on printed images. To prevent such streaks, the surface of the developing roller 51 is covered with a layer of urethane rubber. Then, the surface of the urethane rubber is ground with a cylindrical grinding machine to adjust the surface roughness.

{Developing Blade}

The developing blade 40 according to the present embodiment will be described.

The developing blade 40 is in a rectangular plate-like member having a bent portion 40*a* at its one end portion. The radius of curvature R of the bent portion 40*a* is in the range of 0.15 to 0.5 mm. As the developing roller 51 rotates, the bent portion 40*a* slides on the developing roller 51 to form a thin layer of toner on the developing roller 51. The bent portion 40*a* is pressed against the developing roller 51 under a line pressure in the range of 20 to 60 g/cm$^2$. The developing blade 40 wears out due to its contact-engagement with the developing roller 51. Thus, in order that a toner layer having a uniform thickness can be formed throughout the useable lifetime of the developing unit 14, the developing blade 40 is required to be resistive against wear-out and therefore is made of, for example, stainless steel.

The toner supplying roller 61 has a core metal 61*a* made of stainless steel and covered with an electrically conductive resilient layer 61*b* made of silicone. An appropriate amount of carbon is dispersed in the silicone to adjust its electrical resistance. Likewise, the charging roller 12 has a core metal 12*a* made of stainless steel covered with an electrically conductive resilient layer 12*b* made of epichlorohydrin rubber. An appropriate amount of carbon is added to epichlorohydrin rubber to adjust its electrical resistance. The surface of the electrically conductive layer 12*b* is hardened by using isocyanate.

The photoconductive drum 11 is a negatively charged organic photoconductive body having a laminated structure, in which a base body 11*a* made of aluminum is covered with a charge-developing layer 11*b* having a thickness of about 1 μm. The charge-developing layer 11*b* is formed by dispersing a phthalocyanine pigment in an organic resin material, and covered with a charge transferring layer 11*c* having a thickness of about 18 μm. The charge transferring layer 11*c* is formed of polycarbonate resin in which an aryl amine compound is dispersed. Likewise, the transfer roller 212 has a core metal 212*a* made of stainless steel covered with an electrically conductive resilient layer 212*b* formed of an electrically conductive foamed urethane rubber in which an appropriate amount of carbon is dispersed to adjust the electrical resistance of the resilient layer 212*b*.

{Structural Members}

The operation of the structural members surrounding the photoconductive drum 11 will be described. Referring to FIG. 2, the toner in the toner reservoir 50 is transferred by the toner-supplying roller 61 to the developing roller 51. The friction between the toner-supplying roller 61 and the developing roller 51 causes the toner to be charged. As the photoconductive drum 11 rotates in a direction shown by arrow F, the charging roller 12 receives a voltage of −1100 V from a high voltage power supply, not shown, and rotates in a direction shown by arrow E in contact with the photoconductive drum 11. Thus, the charging roller 12 charges the surface of the photoconductive drum 11 to a potential of −600 V.

When the charged surface of the photoconductive drum 11 rotates past the exposing unit 13, the exposing unit 13 selectively irradiates the charged surface of the photoconductive drum 11 to a potential of −50 V in accordance with the image data. The areas on the surface of the photoconductive drum 11 irradiated by the exposing unit 13 form an electrostatic latent image as a whole.

The toner deposited on the developing roller 51 is formed into a thin layer. The toner particles do not become packed but aligned substantially uniformly on the surface of the developing roller 51 to form a thin layer having a thickness of about the volume mean particle diameter DV (μm) of the toner. The toner on the developing roller 51 is charged by the friction between the developing blade 40 and the developing roller 51.

As the photoconductive drum 11 further rotates, the electrostatic latent image on the photoconductive drum 11 reaches the developing roller 51, which in turn supplies the thin layer of toner to the electrostatic latent image so that the electrostatic latent image is developed with the toner into a toner image. The amount of toner transferred from the developing roller 51 to the photoconductive drum 11 can be controlled by the high voltage supplied to the developing roller 51.

Subsequently, the photoconductive drum 11 further rotates so that the toner image reaches the transfer roller 212. The transfer roller 212 transfers the toner image onto the recording medium 205. The recording medium 205 then advances to the fixing unit 213 (FIG. 1) where the toner image on the recording medium 205 is fused into a permanent image. The recording medium 205 is then discharged to the stacker 218.

Residual toner or toner particles failed to be transferred onto the recording medium 205 is then removed by the cleaning blade 15 from the photoconductive drum 11. The residual toner is then transported by a toner transporting means, not shown, to a waste toner reservoir where the residual toner is collected into the toner-collecting mechanism 65.

{Experiments}

A description will be given of the experiments performed to determine the specification of the toner for use in the present embodiment, and results of the experiments.

Table 1 lists the particle diameters of silica as an external additive to the toner and corresponding values of toner fluidity. Table 2 lists image quality of printed images for various toners with external additives. Using hexamethyldisilazane, the silica added to the toner has been treated to hydrophobic.

The following are the specifications of the structural members and the toner before an additive is added.

Color of toner: cyan (coloring agent is pigment blue 15:3)
Volume mean particle diameter: 3.8 μm
Roundness: 0.96
Number percent of particles having diameters not larger than 2 μm: 16.8%
Volume percent of particles having diameters not smaller than 6 μm: 0.1%
Fluidity (without additives): 54%
Ten-point height of irregularities, Rz on developing roller: 3.1 μm
Line pressure of developing blade: 20 g/cm$^2$
Radius of curvature of bent portion: 0.18 mm

TABLE 1

| silica (weight parts) | Fluidity of toner (%) Diameter of silica particles (nm) | | | |
|---|---|---|---|---|
| | 8 | 16 | 20 | 30 |
| 0.5 | 62 | 60 | 61 | 56 |
| 1.0 | 78 | 75 | 76 | 52 |
| 3.0 | 82 | 80 | 84 | 45 |
| 5.0 | 68 | 62 | 56 | 48 |

(Amounts of silica represent a proportion of silica to 100 weight parts toner)

As is clear from Table 1, when the diameter of silica is in the range of 8 to 20 nm, fluidity can be greater than 70% for 1.0 weight parts additive and 3.0 weight parts additive. Further, when the diameter of silica is in the range of 8 to 20 nm, fluidity can not be greater than 70% for 0.5 weight parts additive and 5.0 weight parts additive so that the fluidity increases only slightly for the amount of additive. In contrast, when the diameter of silica is 30 nm, fluidity does not exceed 60% regardless of the amount of silica added, showing that the additive is not effective in increasing fluidity significantly.

Table 2 lists the results of experiments using four different types of toners.

TABLE 2

| | diameter (nm) | | | |
|---|---|---|---|---|
| | 8 | 8 | 16 | 30 |
| | amount of additive (weight parts) | | | |
| | 3.0 | 5.0 | 1.0 | 0.5 |
| | fluidity (%) | | | |
| | 82 | 68 | 75 | 56 |
| Blurring | ○ | ○ | ○ | X |
| reproducibility of dot | ○ | ○ | ○ | X |
| filming | ○ | X | ○ | ○ |

Using Model C7500n COLOR LED PAGE PRINTER (available from OKI DATA, JAPAN), the quality of image was evaluated in terms of image quality after printing 20,000 pages at room temperature. "Blurring" indicates an image of poor quality in which when an image is printed on 20 pages of A4 size (21 cm×29.7 cm) paper on their substantially entire surface at a print duty of 100%, a brushing mark having a low-density appears in a printed image.

"Reproducibility of dots" represents an image of poor quality in which when an image is printed on the substantially entire surface of A4 size paper in the 1200 dpi (dot per inch) mode at a print duty of 360,000 dots per 1 inch square (1 in.×1 in.), dots are surrounded by unwanted toner particles or toner particles are absent from dots to be printed.

"Filming" represents an image of poor quality in which small characters are blurred or streaks appear in a printed image due to the fact that the toner or additives of the toner melt to adhere to the surface of the photoconductive drum 11, developing blade 40, or developing roller 51.

Symbol "○" indicates that no deterioration of image was observed. Symbol "X" indicates deterioration of images was observed.

As is clear from Table 2, when 0.5 weight parts silica having a particle diameter of 30 nm was added to the toner, the fluidity was as low as 56% and therefore blurring and reproducibility of dots were poor. When 0.5 weight parts silica having a particle diameter of 8 nm was added to the toner (fluidity is 68%), streaks occurred. This is considered to be due to the fact that silica comes off toner particles and adheres to the developing blade 40 as well as toner particles melt to adhere to the developing blade 40. The values of fluidity of not less than 70% do not cause poor quality of images and characters.

In addition to the results listed in Table 1 and Table 2, the inventors conducted additional experiments using additional types of toners. These additional types of toners were prepared by adding different amounts of different external additives, i.e., silica that has been subjected to hydrophobic treatment in different ways. When 0.5 to 3.0 weight parts additive having diameters in the range of 8 to 20 nm was added, the fluidity tended to increase with increasing particle diameter and amount of the external additive. The larger the fluidity, the better the reproducibility of dots and the less blurring. Fluidity lower than 70% causes rapid deterioration of blurring and reproducibility of dots. Filming tended to become poor with increasing amount of the external additive. A maximum amount of the additive was 3.0 weight parts that does not cause filming.

The aforementioned evaluation reveals that 1.0 to 3.0 weight parts external additive having particle diameters in the range of 8 to 20 nm should be added to the toner in order to achieve good reproducibility of dots and prevent blurring and filming.

Table 3 lists the toner characteristics and corresponding image quality. Table 4 lists the toner characteristics and corresponding cleaning operation, character printing, and image quality. The measurements were made with the following conditions.

Color: cyan (coloring agent is pigment blue 15:3)
Additive: hydrophobic silica
Particle diameter: 8 nm
Amount added: 1.0 weight parts
Ten-point height of irregularities, Rz on developing roller: 3.1 μm
Line pressure of developing blade: 20 g/cm$^2$
Radius of curvature of bent portion: 0.18 mm Table 3 lists experimental results when toner having a volume mean particle diameter of 7.3 μm is used.

TABLE 3

| Roundness | 0.97 | 0.96 | 0.92 | 0.88 |
|---|---|---|---|---|
| Reproducibility of dots | X | X | X | X |

Image quality (reproducibility of dots) was evaluated by using the Model C7500n COLOR LED PAGE PRINTER in the 1200 dpi mode. Images having 360,000 dots per 1 inch square (1 in.×1 in) were printed on A4 size paper over its substantially entire surface. The developing unit and toner had not been subjected to accelerated life time test. No good reproducibility was observed for the toner having a volume mean particle diameter of 7.3 μm regardless of the roundness of the toner.

Experiments were carried out using the Model C7500n COLOR LED PAGE PRINTER. Table 4 lists experimental results.

TABLE 4

| | volume mean particle diameter (μm) | | | | | | | |
|---|---|---|---|---|---|---|---|---|
| | 3.8 | | | | 5.9 | | | |
| | Roundness | | | | | | | |
| | 0.98 | 0.96 | 0.92 | 0.86 | 0.99 | 0.96 | 0.91 | 0.88 |
| Cleaning | X | ○ | ○ | ○ | X | ○ | ○ | ○ |
| thickness of layer (μm) | 4.1 | 4.2 | 4.0 | 7.1 | 5.9 | 6.1 | 6.5 | 9.8 |
| Reproducibility of dots | ○ | ○ | ○ | ○ | ○ | ○ | ○ | ○ |
| Blurring | ○ | ○ | ○ | ○ | ○ | ○ | ○ | ○ |
| Variation of density | ○ | ○ | ○ | X | ○ | ○ | ○ | X |

"Cleaning" represents whether toner had adhered to the charging roller 12 (FIG. 2) after 20,000 pages have been printed. If the toner had adhered to the charging roller 12, it was determined that the toner particles had passed through the gaps between the cleaning blade 40 and the photoconductive drum 11 and therefore cleaning had failed.

"Thickness of layer" represents the thickness of a toner layer on the developing roller 51. The thickness of layer is determined as follows: The developing roller 51 was taken out of the developing unit 14 in FIG. 2. Measurements were made of the outer diameter of the developing roller 51 before and after the toner layer was removed by sucking the toner particles with a vacuum cleaner. The thickness of the toner layer was determined by taking the difference between the two measurements of diameter. The outer diameter of the developing roller 51 was measured with the Model LS-3000 optical micrometer available from KEYENCE.

"Variation in density" represents whether variation in density is observable in printed images after printing on the substantially entire surfaces of 20,000 pages of A4 size paper.

"Blurring" and "Reproducibility of dots" are evaluated in the same manner as those in Tables 2 and 3.

As is clear from Table 4, cleaning failed if the roundness is larger than 0.97 (i.e., particles are close to sphere) for volume mean particle diameters 3.8 μm and 5.9 μm. If the roundness was smaller than 0.90 (i.e., toner particles have rough surfaces), "variation in density" occurred and "thickness of layer" was clearly larger than the volume mean particle diameter. This shows that too large a volume mean particle diameter fails to uniformly form a thin layer of toner across the entire surface of the developing roller 51.

Additional experiments were conducted for toners having different characteristics to evaluate the toners in terms of the respective items listed in Tables 3 and 4. "Reproducibility of dots" deteriorates with increasing volume mean particle diameter. Volume mean particle diameters not smaller than 7.0 μm fail to provide sufficient reproducibility of dots. Further, reproducibility of dots deteriorates with increasing roundness, and roundness smaller than 0.9 causes rapid deterioration of reproducibility of dots. The smaller the volume mean particle diameter or the larger the roundness (approaches 1), the more chance of poor cleaning. Toner particles having a volume mean particle diameter of 1 μm and a roundness of 0.97 do not cause poor cleaning. Toner particles having volume mean particle diameters in the range of 1 to 7 μm and roundnesses larger than 0.97 caused poor cleaning.

Considering the aforementioned experimental results, the toner according to the invention should have volume mean particle diameters in the range of 1 to 7 μm and roundnesses in the range of 0.90 to 0.97.

Table 5 lists the particle size and corresponding print quality for toner particles having a volume mean particle diameter of 5.9 μm. The measurements were made with the following conditions.

Color: cyan (coloring agent is pigment blue 15:3)
Volume mean particle diameter: 5.9 μm
Roundness: 0.96
Additive: hydrophobic silica
  particle diameter: 8 nm
  amount added: 1.0 weight parts
Ten-point height of irregularities, Rz on developing roller: 3.1 μm
Line pressure of developing blade: 20 g/cm$^2$
Radius of curvature of bent portion: 0.18 mm

TABLE 5

| | Volume percent of particles not smaller than 12 μm | | |
|---|---|---|---|
| | 5.0 | 1.1 | 0.1 |
| | Number percent of particles not larger than 3 μm | | |
| | 36 | 18 | 13 |
| Cleaning | X | ○ | ○ |
| Reproducibility of dots | X | ○ | ○ |
| Variation in density | X | ○ | ○ |

Measurements were made using the Model C7500n COLOR LED PAGE PRINTER and printing was performed on 20,000 pages at room temperature. The measured values were evaluated in the same manner as those in Table 4.

As is clear from Table 5, toner having particle sizes distributed over a wide range (i.e., particles having a diameter not smaller than 12 μm represent 5% by volume and particles having a diameter not larger than 3 μm represent 36% by number) causes poor "Cleaning", "Reproducibility of dots", and "Variation in density". Additional experiments were conducted for toners having different distributions of particle sizes to evaluate the toners in terms of the respective items as listed in Table 5. The test results reveal that toner having a wide range of particle-size distribution causes poor print results: large-diameter particles result in poor reproducibility of dots and small-diameter particles result in poor cleaning.

If toner particles having particle diameters larger than DV×2 μm represent more than 1% by volume, the reproducibility of dots is poor. If toner particles having particle diameters larger than DV×0.5 μm represent more than 20% by number, the cleaning failure tends to occur. Thus, considering the aforementioned experimental results, the toner according to the invention should be such that the small-diameter particles (not larger than DV×0.5 μm) represent not more than 20% by number and large-diameter particles (not smaller than DV×2 μm) represent not more than 1% by volume.

The wider the range in which the particle size is distributed, the more chance of the variation in thickness of toner layer formed on the developing roller 51 and the more chance of the variation in charging of the toner. This is considered to be due to the following facts:

(1) The charging characteristic of toner depends on the particle diameter.

(2) If small-diameter particles and large-diameter particles represent a large percentage of the total amount of toner, the characteristics of the small-diameter particles and large-diameter particles are combined in effect to contribute to the overall characteristic of the toner.

Additional experiments were conducted to determine the relation between the thickness of toner layer formed on the developing roller 51 and the radius of curvature of the surface of the developing blade 40 in contact with the developing roller 51, and the relation between the line pressure of the developing blade 40 and the thickness of toner layer formed on the developing roller 51. The experimental results will be described with reference to FIGS. 3 and 4.

Figure 3:
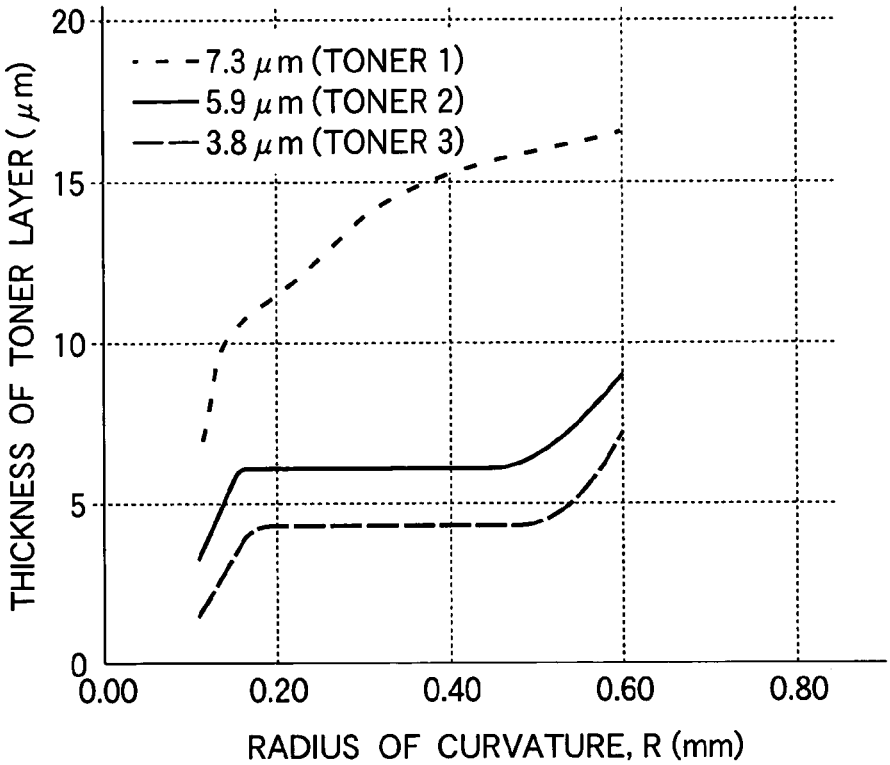
FIG. 3 shows plots of thickness of toner layer versus radius of curvature of a developing blade.

The experiments were conducted for three types of toners having different particle sizes as follows:

Toner #1
Volume mean particle diameter: 7.3 μm
Roundness: 0.96
Percentage of particles (a diameter not larger than 2 μm) by number: 13.2%
Percentage of particles (a diameter not smaller than 14 μm) by volume:0.0%
Toner #2
Volume mean particle diameter: 5.9 μm
Roundness: 0.96
Percentage of particles (a diameter not larger than 3 μm) by number: 13.0%
Percentage of particles (a diameter not smaller than 12 μm) by volume:0.1%
Toner #3
Volume mean particle diameter: 3.8 μm
Roundness: 0.96
Percentage of particles (a diameter not larger than 2 μm) by number: 16.8%
Percentage of particles (a diameter not smaller than 6 μm) by volume:0.1%
Additive: hydrophobic silica
Particle diameter: 8 nm
Amount added: 1.0 weight parts
Color: Cyan (Coloring agent is pigment blue 15:3)
Ten-point height of irregularities, Rz on developing roller: 3.1 μm FIG. 3 shows plots of thickness of toner layer versus radius of curvature R of the developing blade 40. The line pressure of the developing blade 40 was 20 g/cm$^2$. The developing unit 14 and toner had not been subjected to an accelerated life time test (i.e. fresh, unused developing unit and toner were used). The thickness of the toner layer was measured in the same way as those listed in Tables 4.

Referring to FIG. 3, the thickness of layer of a toner having a volume mean particle diameter of 7.3 μm varies depending on the radius of curvature R of the developing blade 40. This implies that the thickness of layer varies with changing dimensions of the developing blade 40 and the developing roller 51 due to wear-out and environmental changes over the time period from when the developing unit 14 is used for the first time until the end of its lifetime. In other words, the image quality changes significantly over time. For toners having volume mean particle diameters of 5.9 μm and 3.8 μm, the radius of curvature R in the range of 0.15 to 0.50 mm do not cause detectable changes in the thickness of toner layer. In other words, the thickness of layer does not change with changing dimensions of the developing blade 40 and the developing roller 51 over the time period from when the developing unit 14 is used for the first time until the end of its lifetime. Thus, the change in image quality is small over time.

Figure 4:
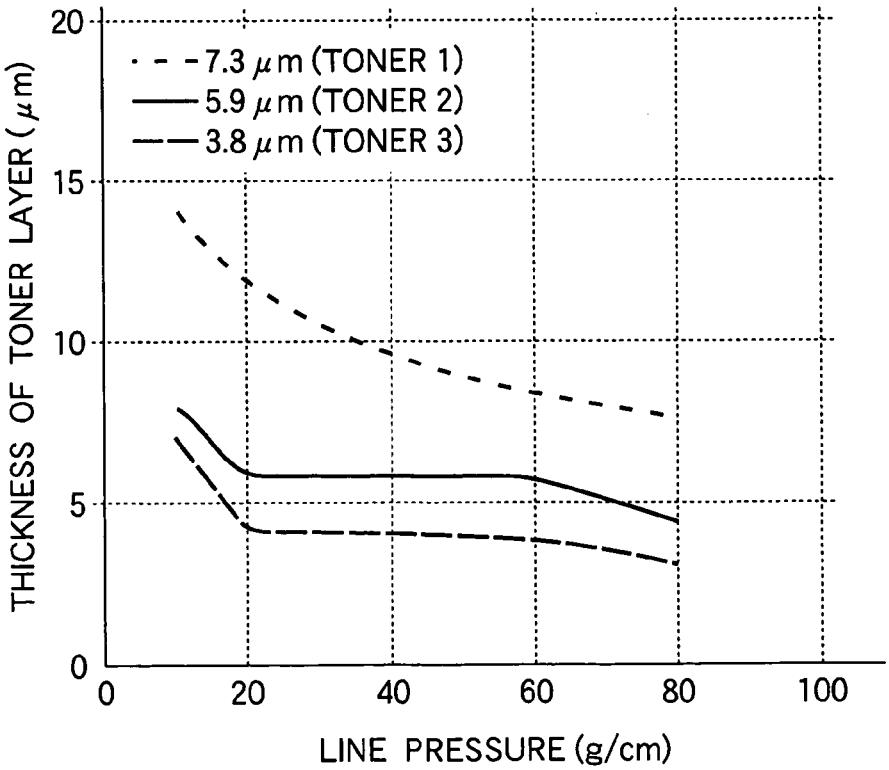
FIG. 4 shows plots of thickness of toner layer and line pressure exerted by the developing blade on a developing roller.

FIG. 4 shows plots of thickness of toner layer and line pressure. The plots in FIG. 4 assume that the radius of curvature R of the developing blade 40 is 0.18 mm. Experiments were conducted with the same conditions as in the experiment in FIG. 3.

Referring to FIG. 4,the thickness of layer of a toner having a volume mean particle diameter of 7.3 μm varies depending on the line pressure of the developing blade 40 exerted on the developing roller 51. This implies that the thickness of toner layer changes with changing dimensions of the developing blade 40 and the developing roller 51 over the time period from when the developing unit 14 is used for the first time until the end of its lifetime, in other words, the image quality changes significantly over time. For toners having volume mean particle diameters of 5.9 μm and 3.8 μm, line pressures in the range of 20 to 60 g/cm$^2$ do not cause detectable changes in the thickness of toner layer. In other words, the thickness of layer does not change with changing dimensions of the developing blade 40 and the developing roller 51 due to wear-out and environmental changes over the time period from when the developing unit 14 is used for the first time until the end of its lifetime. Thus, the image quality does not change significantly over time.

The aforementioned experimental results reveal that the bent portion 40*a* of the developing blade 40 according to the present invention should have a radius of curvature R in the range of 0.15 to 050 mm and apply a line pressure in the range of 20 to 60 g/cm$^2$.

As described a above, the developing unit 14 according to the first embodiment is capable of forming a desired thin layer of toner on the surface of the developing roller 51. Therefore, the developing unit 14 according to the first embodiment offers an image-forming apparatus capable of printing high quality images.

Second Embodiment

Figure 5:
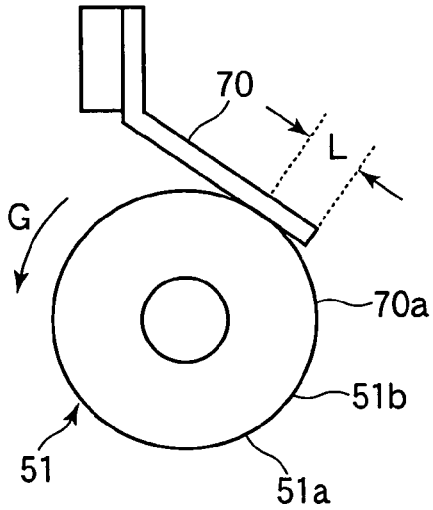
FIG. 5 illustrates a developing blade according to a second embodiment.

FIG. 5 illustrates a developing blade 70 according to a second embodiment.

A developing unit equipped with this developing blade 70 differs from the developing unit 14 according to the first embodiment in that the developing blade 70 abuts the developing roller 51 in a manner different from the developing blade 40. Thus, the structural elements common to the developing unit 14 according to the first embodiment and the developing unit according to the second embodiment have been given the same reference numerals and the description thereof is omitted. A description will be given of structural elements different from the developing unit 14.

Referring to FIG. 5, the developing blade 70 is a rectangular plate-like member having a flat contact portion 70*a*. The contact portion 70*a* abuts the circumferential surface of the developing roller 51 under a certain pressure to limit the amount of toner on the developing roller 51, thereby forming a thin layer of toner on the developing roller 51.

The developing blade 70 is positioned relative to the developing roller 51 such that the developing blade 70 has a free end that extends further ahead of the contact portion 70 a by a distance L. The distance L ranges from 0.5 mm to 2.0 mm. The pressure exerted by the developing blade 70 on the developing roller 51 is i.n the range of 30 to 120 g/cm$^2$. Because the contact portion 70*a* is subject to wear, the developing blade 70 is required to be wear-resistant so that a toner layer of a stable uniform thickness can be formed throughout the useable life of the developing unit 14. Thus, the developing blade 70 is made of, for example, stainless steel.

As the developing roller 51 rotates in a direction shown by arrow G, the toner on the developing roller 51 is formed into a thin layer by the developing roller 70. The toner particles do not become packed but are uniformly aligned on the developing roller 51 into a thin layer. An average thickness of the thin layer is substantially the same as the volume mean particle diameter DV μm. At this moment, the toner on the developing roller 51 is subject to the friction between the developing blade 70 and the developing roller 51, so that the toner is triboelectrically charged.

Experiments were conducted to investigate the relation between the distance L and the thickness of the toner layer formed on the developing roller 51 and the relation between the line pressure of the developing blade 70 and the thickness of the toner layer formed on the developing roller 51. The results of the experiments will be described with reference to FIG. 6 and FIG. 7.

The experiments were conducted for three types of toners having different particle diameters with the following conditions.

Figure 6:
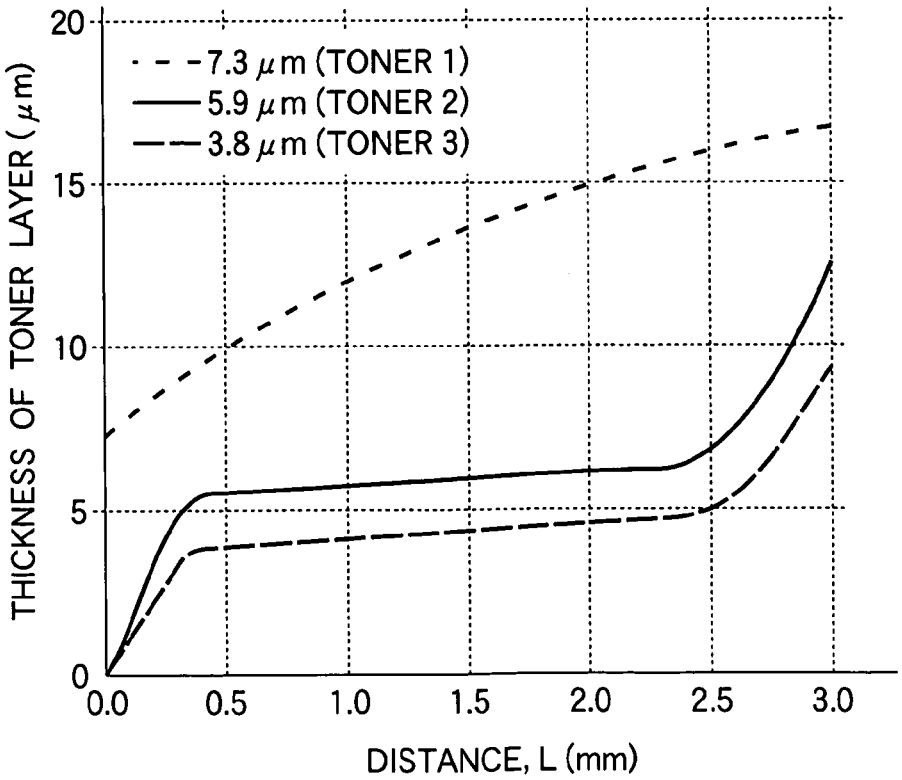
FIG. 6 is a graph of distance L and thickness of the toner layer.

Toner #1
Volume mean particle diameter: 7.3 μm
Roundness: 0.96
Percentage of particles (a diameter not larger than 2 μm) by number: 13.2%
Percentage of particles (a diameter not smaller than 14 μm) by volume:0.1%
Toner #2
Volume mean particle diameter: 5.9 μm
Roundness: 0.96
Percentage of particles (a diameter not larger than 3 μm) by number: 13.0%
Percentage of particles (a diameter not smaller than 12 μm) by volume:0.1%
Toner #3
Volume mean particle diameter: 3.8 μm
Roundness: 0.96
Percentage of particles (a diameter not larger than 2 μm) by number: 16.8%
Percentage of particles (a diameter not smaller than 6 μm) by volume:0.1%
Additive: hydrophobic silica
Particle diameter: 8 nm
Amount added: 1.0 weight parts
Color: Cyan (Coloring agent is pigment blue 15:3)
Average roughness at 10 points on developing roller: 3.1 μm FIG. 6 is a graph of distance L and thickness of the toner layer. The line pressure was 40 g/cm$^2$. The developing unit and toner had not been subjected to accelerated life time test. The thickness of the toner layer was measured in the same way as the thickness in Table 4.

As shown in FIG. 6, the thickness of toner layer changed rapidly with the distance L (FIG. 5) for toner #1 having a volume mean particle diameter of 7.3 μm. This implies that the thickness of the toner layer changes over the time period from when the developing unit is first used until the end of its lifetime, due to wear of the developing blade 70 and developing roller 51 and changes in environmental conditions, thus causing changes in print quality over time. For toners #2 and #3 having volume mean particle diameters of 5.9 μm and 3.8 μm, respectively, the thickness of toner layer does not change significantly as long as the distance L remains in the range of 0.5 to 2.2 mm. Therefore, the thickness of toner layer shows little or no change despite dimensional changes of the structural members over the time period from when the developing unit is first used until the end of its lifetime, thus preventing changes in print quality over time.

Figure 7:
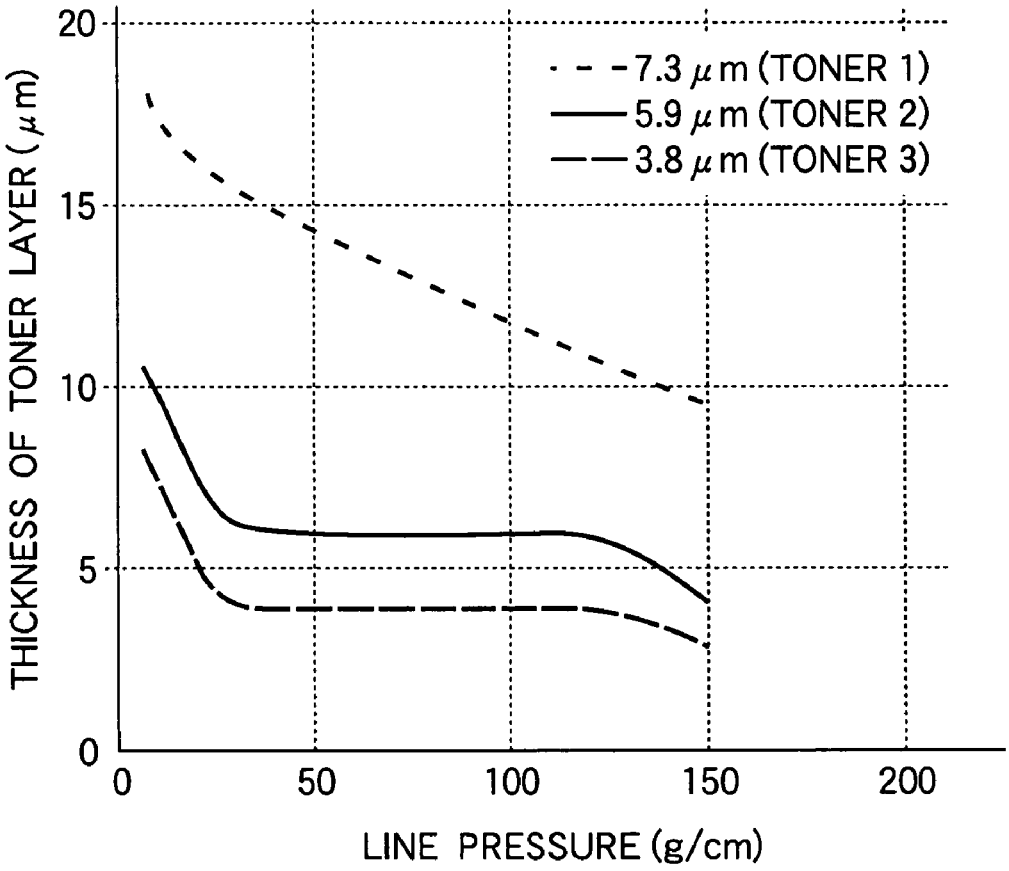
FIG. 7 is a graph of line pressure and thickness of the toner layer.

FIG. 7 is a graph of line pressure and thickness of the toner layer. The distance L was 1.0 mm and measurement was carried out under the same conditions as those in FIG. 6.

As shown in FIG. 7, the thickness of toner layer changes rapidly with the line pressure for toner #1 having a volume mean particle diameter of 7.3 μm. This implies that the thickness of the toner layer changes over the time period from when the developing unit is first used until the end of its lifetime, due to wear of the developing blade 70 and developing roller 51 and changes in environmental conditions, thus causing large changes in print quality over time. For toners #2 and #3 having volume mean particle diameters of 5.9 μm and 3.8 μm, respectively, the thickness of toner layer does not change significantly as long as the line pressure remains in the range of 30 to 120 g/cm$^2$. Therefore, the thickness of toner layer shows little or no change despite the dimensional changes of the structural members over the time period from when the developing unit is first used until the end of its lifetime, thus causing little or no change in print quality over time.

The aforementioned experimental results reveal that the distance L should be in the range of 0.5 to 2.0 mm and the line pressure should be in the range of 30 to 120 g/cm$^2$.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A developing apparatus that develops an electrostatic latent image formed on an image-bearing body with a developer into a visible image, comprising:

a developer-bearing body having a surface on which a thin layer of the developer is formed, said developer-bearing body (51) being disposed such that the thin layer of the developer is brought into pressure contact with the image-bearing body;

a developer-layer forming member that is in pressure contact with the surface of said developer-bearing body to form the thin layer of the developer on said developer-bearing body;

a developer-supplying body that supplies the developer to the surface of said developer-bearing body;

wherein the developer has particles such that (1) developer particles have a volume mean particle diameter DV in the range of 1 μm<DV<7 μm, (2) the developer particles have a roundness in the range of 0.9<roundness<0.97, (3) small-diameter particles not smaller than DV×0.5 μm represent not more than 20% of a total number of particles by number percentage, and (4) large-diameter particles not smaller than DV×2.0 μm represent not more than 1% of a total volume of particles by volume percentage;

wherein the surface of said developer-bearing body has an average surface roughness Rz such that 1 μm<Rz<DV, Rz being ten-point height of irregularities.

2. The developing apparatus according to claim 1, wherein said toner-layer forming member has a plate-like shape and a bent portion at which said toner-layer forming member is in pressure contact with said developer-bearing body under a line pressure in the range of 20 to 60 g/cm$^2$, wherein the bent portion has a radius of curvature in the range of 0.15 to 0.50 mm.

3. The developing apparatus according to claim 2, wherein said toner-layer forming member is made of stainless steel.

4. The developing apparatus according to claim 1, wherein the surface of said developer-bearing body is a cylindrical surface and said toner-layer forming member has a flat surface in pressure contact with the surface of said developer-bearing body under a line pressure in the range of 30 to 120 g/cm$^2$, wherein said toner-layer forming member extends over a distance in the range of 0.5 to 2.2 mm ahead of a contact point at which said toner-layer forming member is in contact with said developer-bearing body.

5. The developing apparatus according to claim 3, wherein said toner-layer forming member is made of stainless steel.

6. The developing apparatus according to claim 1, wherein the developer is manufactured by emulsion polymerization.

7. An image forming apparatus incorporating the developing apparatus according to claim 1, comprising:

a cylindrical image-bearing body that rotates about a longitudinal axis;

a transfer member that transfers the visible image from said image-bearing body onto a recording medium; and a resilient cleaning blade that is in contact with a cylindrical surface of said cylindrical image-bearing body, said resilient cleaning blade scrapes off residual developer from the surface of said cylindrical image-bearing body.

* * * * *